US006018320A

United States Patent [19]

Jidhage et al.

[11] Patent Number: 6,018,320

[45] Date of Patent: Jan. 25, 2000

[54] APPARATUS AND A METHOD RELATING TO ANTENNA SYSTEMS

[75] Inventors: Ulf Henrik Jidhage, Alingsås; Bengt Inge Svensson, Mölndal, both of Sweden

[73] Assignee: Telefonaktiebolaget LM Ericsson, Stockholm, Sweden

[21] Appl. No.: 09/066,953

[22] Filed: Apr. 28, 1998

[30] Foreign Application Priority Data

Apr. 30, 1997 [SE] Sweden ..... 9701644

[51] Int. Cl.[7] ..... H01Q 1/38

[52] U.S. Cl. ..... 343/700 MS; 343/767

[58] Field of Search ..... 343/700 MS, 795, 343/767

[56] References Cited

U.S. PATENT DOCUMENTS

| | | | |
|---|---|---|---|
| 4,486,758 | 12/1984 | de Ronde | 343/700 MS |
| 4,825,220 | 4/1989 | Edward et al. | 343/795 |
| 4,903,033 | 2/1990 | Tsao et al. | 343/700 MS |
| 5,241,321 | 8/1993 | Tsao | 343/700 MS |

FOREIGN PATENT DOCUMENTS

| | | |
|---|---|---|
| 2388420 | 11/1978 | France . |
| 2666691 | 3/1992 | France . |
| 507076 | 3/1998 | Sweden . |

OTHER PUBLICATIONS

J.R. Sanford et al., "A Two Substrate Dual Polarised Aperture Coupled Patch", pp. 1544–47, Department of Microwave Technology, Chalmers University of Technology, Gothenburg, Sweden, 1996.

*Primary Examiner*—Don Wong

*Assistant Examiner*—Hoang Nguyen

*Attorney, Agent, or Firm*—Burns, Doane, Swecker & Mathis, L.L.P.

[57] ABSTRACT

An antenna system (100) comprises a substantially planar electrically conductive ground plane (102) with an aperture (103), a substantially planar signal feed structure (104) parallel to the ground plane (102) and a substantially planar first dielectric layer (123) between the ground plane and the feed structure (104). The aperture (103) is in a shape of a first slot (105) orthogonally intersecting a second slot (106) at an intersection point (SIP). The feed structure (104) comprises a first feed unit (107) intersecting the second slot (106) asymmetrically with respect to the first slot (105), and a fork shaped second feed unit (108) comprising two feed arms (110,111). The feed arms (110,111) intersect the first slot (105) on either side of the slot intersection point (SIP), symmetrically with respect to the second slot (106). When used as a transmitting antenna, a first signal (Si) is fed through the first feed unit (107) and a second signal (S2) is fed through the second feed unit (108) to respective associated slot (105,106). The signals (S1,S2) excite the aperture (103) to radiate two substantially orthogonal linearly polarized signals.

16 Claims, 3 Drawing Sheets

APPARATUS AND A METHOD RELATING TO ANTENNA SYSTEMS

TECHNICAL FIELD OF THE INVENTION

The present invention relates to microwave antenna systems capable of transmitting and receiving microwave radiation, and in particular signal feed structures of aperture coupled microwave antennas.

DESCRIPTION OF RELATED ART

In the field of microwave radiocommunication, it is often advantageous to utilize radiation which is dual polarized. A well known example of an application where dual polarized microwaves are used is in communication with spaceborne satellites. As opposed to a situation with single polarization, each and every carrier frequency band can be used to communicate two independent channels of information. A first channel of information can be modulated onto a dual linearly polarized carrier signal, where the linear polarization is along a first direction, and a second channel of information can be modulated onto the same carrier signal with a linear polarization along a second direction orthogonal to the first direction.

Many implementations of means for communication with dual polarized microwaves are known in the art, and many features in these means are subject to intensive technical development. One essential area in which development is taking place, is in the field of the antenna elements and the means needed to feed the antenna elements with signals for transmission and reception. Constraints are put on these feed and antenna means by the desired performace in terms of, e.g., cross-polarization of the dual polarized electromagnetic far-field and isolation between connection ports of the signal feed means.

From the U.S. Pat. No. 4,903,033 it is known a dual polarization aperture coupled antenna usable for microwave signal. Orthogonal linearly polarized signals can be transmitted, and received, via a number of microstrip patches and a ground plane aperture which is in the shape of two orthogonal slots intersecting at their midpoints. Two identical fork shaped signal feed networks feed signals to and from the slots.

A drawback of the antenna disclosed in U.S. Pat. No. 4,903,033 is that the two feed networks must be symmetrically arranged in order to minimize the negative influence of cross-polarization and mutual coupling between the networks. To overcome this, U.S. Pat. No. 4,903,033 shows that the feed networks cross each other by means of an air bridge crossover.

Another dual polarized aperture coupled antenna is described by Sanford, J. R. and Tengs, A. in "A Two Substrate Dual Polarised Aperture Coupled Patch", IEEE AP-S Intl. Symp. 1996, Vol. 3 pp. 1544–1547. An aperture of two orthogonal slots is fed by a dual feed network, symmetrically located with the aperture. The problem of having a symmetric feed without a need for crossing of the two feed networks is solved by placing the two networks on opposite sides of a multi layered structure, in such a way that the aperture is sandwiched between the feed networks and two dielectric substrate sheets.

The antenna disclosed by Sanford and Tengs is a complicated structure since the feed networks are located on different dielectric substrate sheets. Also, one of the feed networks situated above the aperture plate and consequently not shielded from the exterior. Direct leakage radiation from the network can then interfere with the radiation from the aperture and/or the patch.

SUMMARY OF THE INVENTION

The present invention aims to overcome the following problems, as illustrated by the drawbacks of the above recited prior art.

A first problem is how to obtain an aperture coupled dual linearly polarized microwave antenna which is compact and simple in its construction.

Another problem which the present invention aims to solve is how to obtain an aperture coupled dual linearly polarized microwave antenna having dual feed networks, where the electric isolation between the feed networks is optimized.

The object of the present invention is thus to overcome the above stated problems, as well as providing a method for transmission and reception of dual linearly polarized microwaves.

This is obtained in an inventive manner by an aperture coupled antenna system comprising two orthogonal slots in a ground plane, a first feed unit feeding the first slot symmetrically with respect to its midpoint and a second feed unit feeding the second slot asymmetrically with respect to its midpoint.

More precisely, the antenna system according to the invention comprises a substantially planar electrically conductive ground plane with an aperture, a substantially planar signal feed structure parallel to the ground plane and a substantially planar first dielectric layer between the ground plane and the feed structure.

The aperture is in a shape of a first slot orthogonally intersecting, at an intersection point, a second slot. The feed structure comprises a first feed unit intersecting the second slot asymmetrically with respect to the first slot, and a fork shaped second feed unit comprising two feed arms. The feed arms intersect the first slot on either side of the slot intersection point, symmetrically with respect to the second slot.

When used as a transmitting antenna, a first signal is fed through the first feed unit and a second signal is fed through the second feed unit to respective associated slot. The signals excite the aperture to radiate two substantially orthogonal linearly polarized signals.

An advantage of the present invention is that it reduces the electrical coupling between the two feed units, that is, a signal present in the first feed unit is not transmitted to the second feed unit.

Another advantage of the present invention is that it is possible to implement the feed networks as an arrangement on one side of a single sheet of substrate making it a compact arrangement.

Yet another advantage is that the inventive arrangement can be constructed without complex structures such as airbridges, making the implementation of the invention simple.

DETAILED DESCRIPTION OF PREFERRED EMBODIMENTS

Figure 1:
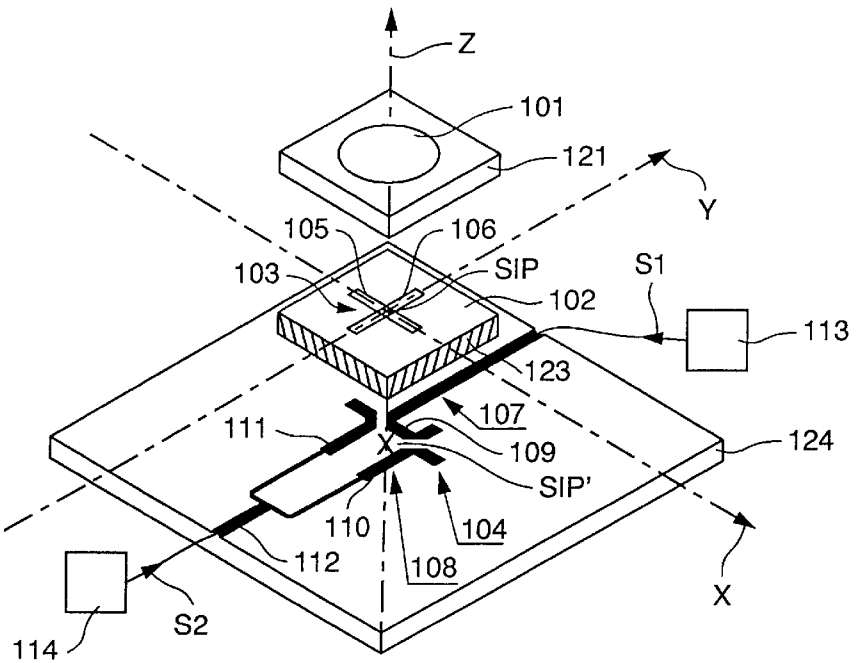
FIG. 1 shows a schematic exploded perspective view of a first embodiment of an aperture coupled microwave patch antenna.

FIG. 1 is an illustration of an antenna system 100 according to the invention. Only the arrangements pertinent to the implementation of the invention are discussed in detail and thus the figure does not explicitly reveal any details within external devices such as radio transmitters or receivers. It is assumed that transmitters and receivers, as well as any mechanical mounting arrangements needed, are means well known in the art which the skilled person readily applies when using the invention. For simplicity and purely illustrative purposes, a rectangular coordinate system is used to clarify the respective positions and mutual orientation of the different units of the antenna system. A first direction is designated X, and a second direction orthogonal to the first direction is designated Y. Orthogonal to both the first direction X and the second direction Y is a third direction Z. The rectangular coordinate system, as defined by the first and second direction X,Y will also be used below in connection with all further embodiments of the invention.

The antenna system 100 comprises an electrically conductive ground plane 102 on a first dielectric layer 123. The ground plane 102 and the layer 123 are situated in a plane defined by the first and second directions X,Y and perpendicular to the third direction Z. The ground plane 102 and the first dielectric layer 123 are shown only partly, as indicated by the hatched edges of the layer 123 and hence they may extend further in the XY-plane. An aperture 103 in the ground plane 102 is in a shape of two intersecting slots. A first slot 105 aligned along the first direction X and a second slot 106 aligned along the second direction Y. The slots 105,106 intersect each other at a slot intersection point SIP. In this example the slots 105,106 are of equal length and intersect each other at their respective midpoints, thus making the aperture 103 symmetric with respect to both directions X,Y.

Parallel with the ground plane 102 and forwardly displaced along the third direction Z, is a second dielectric layer 121. On the second dielectric layer 121 is an electrically conductive circular patch 101 which is centered with respect to the slot intersection point SIP. The patch 101 acts as a mediating unit for the electromagnetic radiation transmitted from, and received by the antenna system 100. Although the patch 101 in this example is circular, other shapes may be used, as will be pointed out below. Moreover, it is possible to use other means as mediating units, such as e.g. waveguides and dipoles, as is known in the art, wherein the mediating unit (101) comprises, for example, a combination of at least a patch (101) and at least a part of a dipole unit, or a combination of at least a path (101) and at least a part of a dipole unit, or a combination of at least a part of a dipole unit and at least a part of a waveguide.

Also parallel with the ground plane 102, but backwards displaced along the third direction Z, is a third dielectric layer 124. On this third dielectric layer 124 a signal feed structure 104 is located. The feed structure 104 is in this example in the form of microstrip conductors. The feed structure 104 includes a first feed unit 107 which comprises a section 109 parallel with the first direction X and displaced along the second direction Y with respect to a projection SIP' on the third dielectric layer 124 of the slot intersection point SIP. A second feed unit 108 is also included in the feed structure 104. This second feed unit 108 comprises a first feed arm 110 and a second feed arm 111. The feed arms 110,111 are parallel with the second direction and are displaced on opposite sides of the projection SIP' of the slot intersection point SIP. A feed joining unit 112 along the second direction Y joins the two feed arms 110,111. The second feed unit 108 with its arms 110,111 and joining unit 112 is symmetric with respect to the second direction Y.

The joining unit 112 and the two feed arms 110,111 are in this embodiment designed as a simple T-shape structure. As is well known to a person skilled in the art this is a splitter/combiner. It is capable of splitting a signal equally in amplitude and phase, and may have a number of different appearances.

A dielectric layer, such as e.g. the third dielectric layer 124 on which the feed structure 104 is located, may consist of any dielectric material known in the art, or combinations of different materials in several sub-layers, including layers of air. However, air layers may necessitate mechanical support units separating the conductive layers involved.

The antenna system 100 can be used for microwave transmission of two orthogonal linearly polarized signals S1,S2. A first transmitter 113 is connected to the first feed unit 107 and a second transmitter 114 is connected to the second feed unit 108. The first transmitter 113 supplies the first signal S1 to the first feed unit 107, and the second transmitter 114 supplies the second feed unit 108 with the second signal S2.

The first signal S1 is coupled to the second slot 106 via the section 109 of the first feed unit 107. The second slot 106 then radiates the first signal S1, linearly polarized, via the patch 101 towards the third direction Z. Similarly, the second signal S2 is coupled to the first slot 105 via the two arms 110,111 of the second feed unit 108. The first slot 105 then radiates the second signal S2 via the patch 101 towards the third direction Z, having a linear polarization which is orthogonal to the polarization of the first signal S1 radiated from the second slot 106.

A signal having circular polarization can be transmitted with the antenna system described. This is obtained, as is known in the art, by supplying the same signal to both feeds and phase-shifting either one of the two signals S1,S2 by 90 degrees.

The main purpose of having a patch 101 acting as a mediating unit is that it enables, according to already known art, enhanced control of the characteristics of the antenna system, such as e.g. bandwidth, impedance and radiation pattern, as compared to a situation with only a radiating aperture 103. In fact, the capability of controlling the characteristics of the antenna system is even further enhanced by stacking a number of patches 101 interleaved with dielectric layers 121. It should, however, be pointed out that the aperture 103 is capable of transmitting the signals S1,S2 without a mediating unit.

It should also be pointed out that the antenna system 100, although described as a transmitting device, can also act as a receiving antenna system. In a receiving situation, an external signal containing at least partly linearly polarized radiation would be inducing a signal in the patch 101. In turn, the linearly polarized components of the received signal would be excited in the two slots 105,106 and further coupled to the respective feed unit 107,108. Hence, it is to be understood that the invention includes implementations of both transmitting antenna systems as well as receiving antenna systems, and antenna systems capable of simultaneous reception and transmission.

Figure 2B:
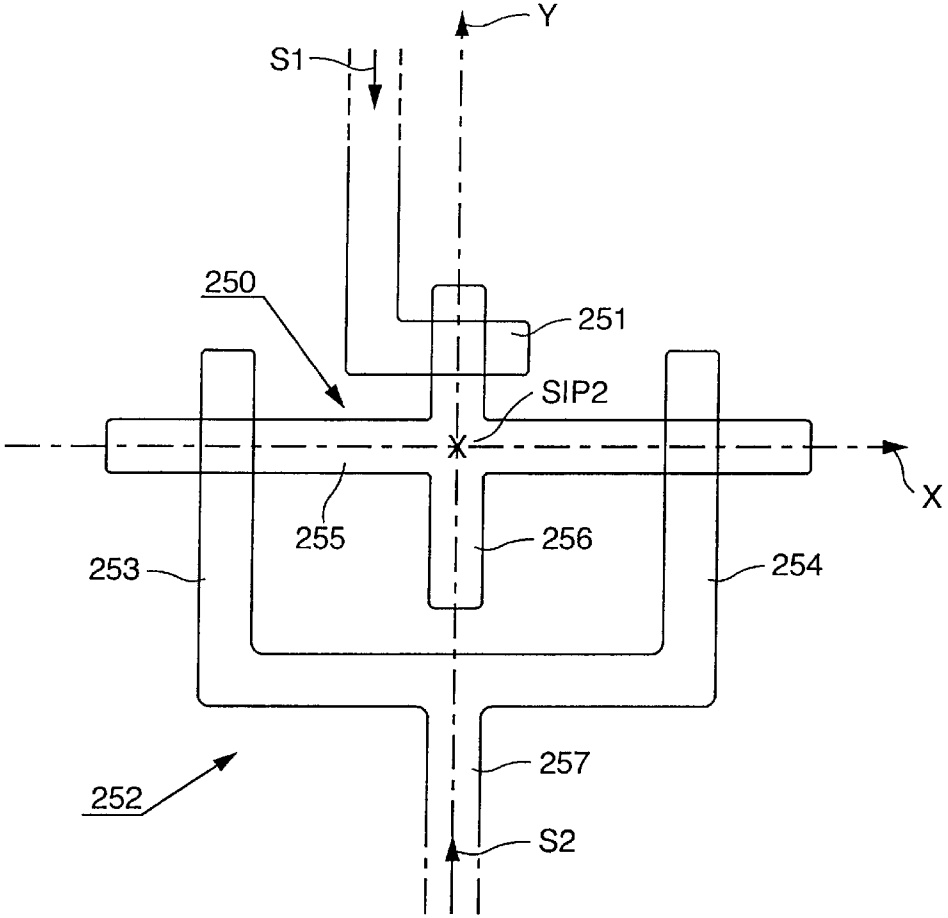
FIG. 2B shows a schematic view of a second embodiment of a feed structure according to the invention.
Figure 2A:
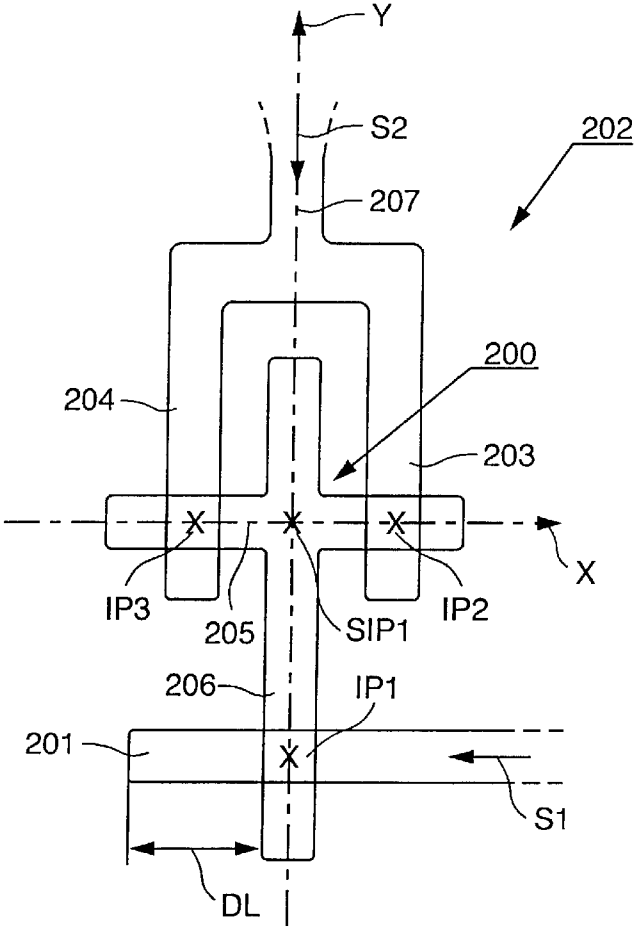
FIG. 2A shows a schematic view of a first embodiment of a feed structure according to the invention.

FIGS. 2A and 2B illustrate different implementations of feed structures and apertures, corresponding to the feed structure 104 and aperture 103 in FIG. 1. In FIG. 2A an aperture 200 and a first and a second feed unit 201,202 are shown. The aperture 200 comprises a first slot 205 aligned along the first direction X and a second slot 206 aligned along the second direction Y. The first slot 205 is shorter than the second slot 206. The slots 205,206 intersect each other at a first slot intersection point SIP1 which is located at the midpoint of the first slot 205 which makes the aperture 200 symmetric with respect to the second direction Y and asymmetric with respect to the first direction X.

A first feed unit 201 and a second feed unit 202 are shown projected onto the plane of the aperture 200. It is to be understood that there is a dielectric layer, not visible in the drawing, between the aperture and the feed units 201,202. The first feed unit 201 is elongated along the first direction X and intersects the second slot 206 at a first intersection point IP1. An extension DL of the first feed unit extends beyond the second slot 206. This extension DL is an impedance matching unit as is well known, and described, in the art. Accordingly, all the present examples show that feed units, such as the first feed unit 201, extend beyond their respective slots. The second feed unit 202 is fork shaped and comprises a first feed arm 203 and a second feed arm 204 joined into a feed joining unit 207. The joining unit 207 extends along the second direction Y and the feed arms 203,204 are parallel with the second direction Y, thus making the second feed unit 202 symmetric with respect to the second direction Y. The first feed arm 203 intersects the first slot 205 at a second intersection point IP2 and the second feed arm 204 intersects the first slot 205 at a third intersection point IP3. These, second and third intersection points IP2,IP3, are symmetrically located on opposite sides of the first slot intersection point SIP1.

FIG. 2B shows another example of a feed structure comprising a first feed unit 251 and a second feed unit 252. As in the previous example described in connection with FIG. 2A, an aperture 250 comprises two intersecting slots, a first slot 255 along the first direction X and a second slot 256 along the second direction Y. The second slot 256 is shorter than the first slot 255. The slots 255,256 intersect at a second slot intersection point SIP2 at the midpoints of respective slot 255,256, making the aperture 250 symmetric with respect to both the first direction X and the second direction Y. As in the previous example, the first feed unit 251 intersects the second slot 256, and the second feed unit 252 intersects the first slot 255 with its first feed arm 253 and second feed arm 254. The two feed arms 253,254 are joined at a joining unit 257.

The two examples in FIG. 2A and 2B illustrate feed networks and apertures capable of transmitting a first signal S1 and a second signal S2, via the slots 205,206, 255,256. The first signal S1 having a typical frequency F1 and the second signal having a typical frequency F2, which is different with respect to the first frequency F1. The length of the slots 205,206,255,256 are each substantially inversely proportional to the frequency of the signal which is to be transmitted from respective slot. A feed network and slot configuration as in FIGS. 2A and 2B can be implemented in an antenna system such as the one described in connection with FIG. 1. Such an antenna system would be capable of transmitting (and receiving) two orthogonal linearly polarized signals S1,S2 having different frequencies F1,F2. In such a case, it is advantageous to have a patch (101 in FIG. 1), or stack of patches, of rectangular or elliptical shape, having a short side/long side ratio or minor axis/major axis ratio substantially the same as the ratio between the lengths of the orthogonally intersecting slots.

Figure 4:
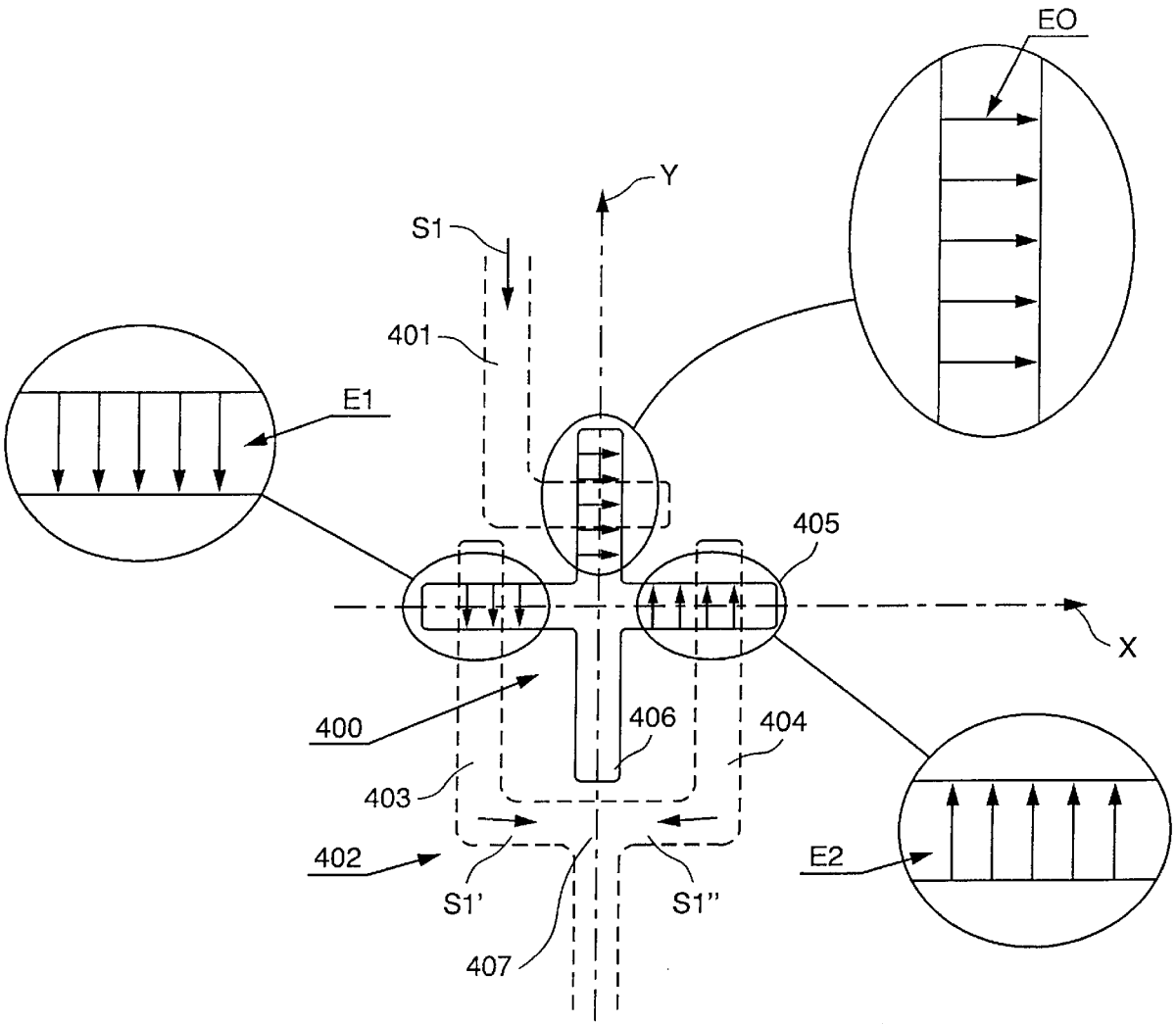
FIG. 4 shows a schematic view illustrating a distribution of electromagnetic vectors in an aperture.

FIG. 4 shows a further embodiment of the invention, which illustrates an advantage of the invention, regarding signal isolation between a first feed unit 401 and a second feed unit 402. The feed units 401,402 are located at an aperture comprised of two symmetrically intersecting slots 405,406 of equal length. As in previous examples, the first feed unit 401 asymmetrically feeds a first signal S1 to the second slot 406 aligned along the second direction Y, and a second feed unit 402 with feed arms 403,404 symmetrically feeds a second signal S2 to the first slot 405.

Isolation between the feed units 401,402 can be expressed in terms of how much power of the first signal S1, emanating from the first feed unit 401, can be transmitted via the aperture 400 to the second feed unit 402. The first signal Si is coupled from the first feed unit 401 to the second slot 405. The signal S1 when coupled to the second slot 406 creates a propagating electromagnetic wave which in the figure is illustrated by a first electric field vector E0 within the slot. The different vectors are to be understood as successive illustrations of a particular point of the wave as it propagates along the slot. The first electric field E0 is coupled from the second slot 406 to the first slot 405 such that a second and a third electric field, illustrated by a second field vector E1 and a third field vector E2 appear in the first slot 405. The second and third electric field E1,E2, which have opposite directions with respect to each other, are then coupled to the two feed arms 403,404 of the second feed unit 402 resulting in two perturbing signals S1' and S1" in the feed arms 403 and 404, respectively. At a joining point 407 of the second feed unit 402, the two perturbing signals S1',S1" cancel each other. This cancellation is due to the fact that, since the electric fields E1,E2 generating the perturbing signals S1', S1" have opposite directions, the two perturbing signals S1',S1" have a 180 degree phase-shift relative to each other.

As is known in the art, due to the fact that the feed units comprise only linear and passive components, there is by definition a reciprocity relation between inputs and responses in the first feed unit 401 and the second feed unit 402. This reciprocity entails that perturbing signals in the direction from the second feed unit 402 to the first feed unit 401 also cancel each other.

Figure 3:
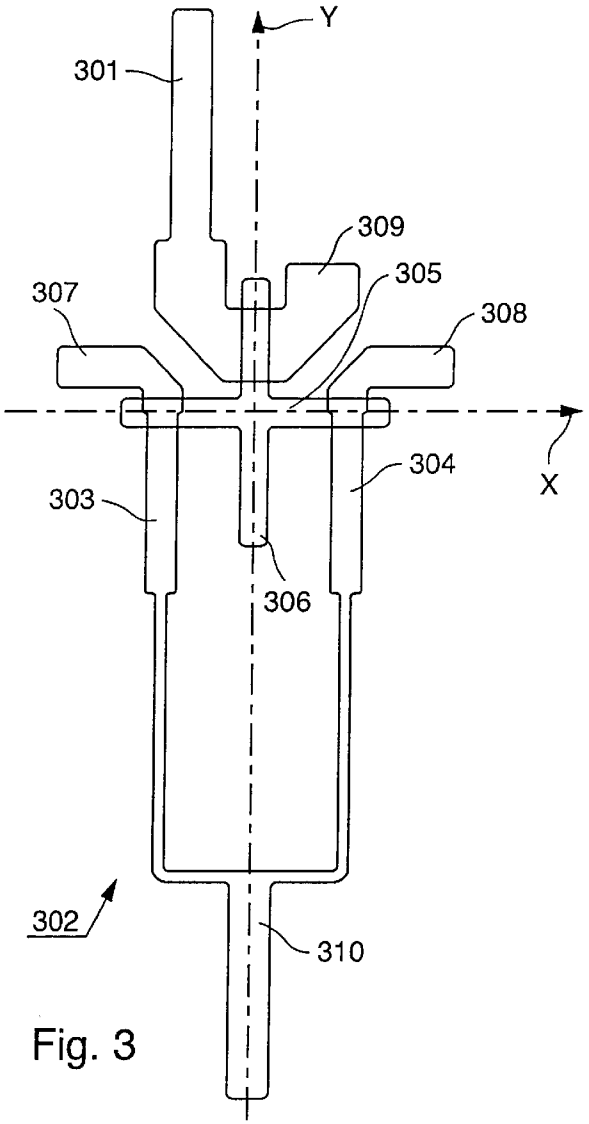
FIG. 3 shows a schematic view of a third embodiment of a feed structure according to the invention.

FIG. 3 illustrates a compact implementation of a feed network comprising a first feed unit 301 and a second feed unit 302. The feed units 301,302 are implemented as microstrip paths, preferably etched from a metal clad dielectric sheet according to known technique. Also shown in FIG. 3 is a projection of a symmetric aperture comprising, as in previous examples, a first slot 305 intersecting a second slot 306. The slots are preferably etched in a ground plane metal layer on a dielectric sheet. The slots 305,306 and the feed units 301,302 may be etched in/from opposing sides of a metal-clad dielectric sheet, or etched in/from two different metal-clad dielectric sheets.

The first feed unit 301 is, as in previous examples described above, intersecting the second slot 306 and comprises a bent extension unit 309. The second feed unit 302 comprises two feed arms 303,304 and a joining unit 310. The two feed arms 303,304 are symmetrically located with respect to the second direction Y and intersect the first slot 305, as in previous examples described above, and have extensions 307,308 bent along the first direction.

The different parts of the feed units 301,302 have different widths, such as e.g. the extension unit 309 of the first feed unit 302 and the extension unit 308 of the second feed unit 302. As is known in the art, this is necessary in order to control the impedance of the units 301,302.

Although it is prefered in the previous example to implement the feed network using known microstrip technique, it is possible to utilize e.g. stripline technique, also known in the art. However, stripline technique necessitates introducing a second ground plane.

We claim:

1. Microwave antenna system (100) comprising:

a substantially planar electrically conductive ground plane (102), an aperture (103) in the ground plane (102), a substantially planar signal feed structure (104) being parallel to the ground plane (102), a substantially planar first dielectric layer (123) located between the ground plane (102) and the feed structure (104), said microwave antenna system (100) wherein the aperture (103) is in a shape of a first slot (105) aligned along a first direction (X) and a second slot (106) aligned along a second direction (Y) orthogonal to the first direction (X), said slots (105,106) intersecting each other at a slot intersection point (SIP), the feed structure comprises a first feed unit (201), at least partly elongated parallel with the first direction (X), intersecting the second slot (206) in a first intersection point (IP1), at which point (IP1) the first feed unit (201) is parallel with the first direction (X), the feed structure comprises a fork shaped second feed unit (202) symmetric with respect to the second direction (Y), comprising a first arm (203) and a second arm (204) extending from a second feed joining unit (207), the arms (203,204) each being at least partly elongated parallel with the second direction (Y), said first arm (203) intersecting the first slot (205) at a second intersection point (IP2) and said second arm (204) intersecting the first slot (205) at a third intersection point (IP3), said second and third intersection points (IP2,IP3) being on opposite sides of the slot intersection point (SIP1), at which second and third intersecting points (IP2,IP3) the first arm (203), and the second arm (204) each are parallel with the second direction (Y).

2. Microwave antenna system (100) according to claim 1, wherein the system (100) also comprises a mediating unit (101) located adjacent to the ground plane (102), whereby the aperture (103) in ground plane (102) is located between the mediating unit and the feed structure (104).

3. Microwave antenna system (100) according to claim 2, wherein the mediating unit (101) comprises a substantially planar microstrip patch (101) and a second substantially planar dielectric layer (121), such that the second dielectric layer (121) is located between the mediating and the ground plane (102) and is parallel with both the patch (101) and the ground plane (102).

4. Microwave antenna system (100) according to claim 2, wherein the mediating unit (101) comprises a multitude of substantially planar stacked microstrip patches (101,107) interleaved with a multitude of substantially planar dielectric layers (121,108).

5. Microwave antenna system (100) according to claim 2 wherein the mediating unit (101) comprises at least a part of a dipole unit.

6. Microwave antenna system (100) according to claim 2, wherein the mediating unit (101) comprises at least a part of a waveguide unit.

7. Microwave antenna system (100) according to claim 1, wherein the slots (105,106) have equal length.

8. Microwave antenna system (100) according to claim 1, wherein the slot intersection point (SIP) coincides with the respective midpoints of the slots (105,106).

9. Microwave antenna system (100) according to claim 1, wherein the first feed unit (201) and the second feed unit arms (203, 204) extend beyond their respective associated slot (205, 206).

10. Microwave antenna system (100) according to claim 9, wherein the extension of the first feed unit (201) and feed arms (203,204) comprise straight extension units.

11. Microwave antenna system (100) according to claim 9, wherein the extension of the first feed unit (301) and feed arms (303,304) comprise bent extension units (307,308, 309).

12. Microwave antenna system (100) according to claim 1, wherein the feed structure comprises microstrip units.

13. Microwave antenna system (100) according to claim wherein the feed structure comprises stripline units.

14. Microwave antenna system (100) according to claim 1 wherein the feed structure includes a first feed unit (301) having a first width, said first feed unit (301) comprising an extension unit (309) having a second width, said feed structure includes a fork-shaped second feed unit (302) comprising a joining unit (310) having a third width, said second feed unit (302) comprising two identical feed arms (303,304) each having a fourth width and a fifth width, said feed arms (303,304) each comprising extension units (307, 308) having a sixth width.

15. A method of feeding a first and a second current representing a first and a second signal (S1,S2) to an aperture of a first slot and a second slot orthogonally intersecting each other, producing a dual linearly polarized electromagnetic field in a microwave antenna system, including the following steps:

asymmetrically feeding said first current to the second slot in such a manner that the second slot is excited and generates an electromagnetic field having a first linear polarization, and symmetrically feeding said second current to the first slot by splitting it up in a first and a second path and in such a manner that the the first slot is excited and produces an electromagnetic field having a second linear polarization orthogonal to the first linearly polarized field.

16. A method according to claim 15, including feeding the first signal to the second slot, and feeding the first signal phaseshifted by 90 degrees to the first slot in order to generate an electromagnetic field with circular polarization.

* * * * *